United States Patent [19]

Yamamoto

[11] Patent Number: 4,462,240

[45] Date of Patent: Jul. 31, 1984

[54] HANDGUN, BLIND RIVET INSTALLATION

[75] Inventor: Albert K. Yamamoto, Huntington Beach, Calif.

[73] Assignee: Rexnord Inc., Brookfield, Wis.

[21] Appl. No.: 392,196

[22] Filed: Jun. 25, 1982

[51] Int. Cl.[3] ..... B21D 9/05

[52] U.S. Cl. ..... 72/391; 92/13.6

[58] Field of Search ..... 72/391, 114; 92/13.6

[56] References Cited

U.S. PATENT DOCUMENTS

| | | | |
|---|---|---|---|
| 3,104,592 | 9/1963 | Sheesley | 92/13.6 |
| 4,086,802 | 5/1978 | Ewig, Jr. | 72/391 |
| 4,321,814 | 3/1982 | Martin | 72/391 |

*Primary Examiner*—Francis S. Husar
*Assistant Examiner*—Linda McLaughlin

[57] ABSTRACT

A hydraulic gun for installing inserts in which the hydraulic mechanism becomes inoperative after the mandrel of the gun travels a predetermined distance. The gun includes a means for adjusting the predetermined distance of mandrel movement.

10 Claims, 3 Drawing Figures

HANDGUN, BLIND RIVET INSTALLATION

FIELD OF THE INVENTION

The present invention relates to a tool for installing inserts and more particularly to a hydraulic gun for installing inserts into panels.

BACKGROUND OF THE INVENTION

Hydraulic guns for the installation of rivets and self-locking inserts are well-known and can be obtained from various manufacturers such as the Parker Manufacturing Company in Worcester, Massachusetts. The hydraulics guns are particularly useful in the installation of inserts in sheet metal where the inserts may be used in a number of applications such as mounting brackets to tubing, covers to electronic chassis, and covers to communication equipment. Where it is necessary to place hundreds of such inserts in place, the guns provide a quick and efficient means for installing the inserts.

The hydraulic guns generally are comprised of three parts: the adapter/mandrel assembly; the hydraulic housing; and the pump assembly. The adapter/mandrel assembly is provided with a shaft, i.e., mandrel, with a threaded end upon which an insert is threaded. The hydraulic housing covers, among other parts, a cylinder and a piston which is coupled to the mandrel. The pump assembly supplys the fluid under pressure to the hydraulic housing.

Briefly, the inserts are threaded in the mandrel and are inserted into an opening in a panel until the circular end flange of the insert abuts the panel surface. Generally, the "barrel" or anvil of the gun abuts the flange. Fluid under pressure is then caused to enter the cylinder, resulting in the withdrawal of the anvil. The walls of the insert buckle against the interior surface of the panel, locking the insert in place. The mandrel is unthreaded from the insert which is then ready for use.

When installing inserts of the so-called blind type, a problem can occur when the operator of the gun does not have visual contact with the insert. Most hydraulic guns are of the pump variety which requires the operator to continually pump a lever which actuates the hydraulic mechanisms, causing the mandrel to withdraw. Without visual contact the operator is unable to know except through "feel" whether the mandrel has withdrawn the appropriate distance or not. Too much pumping of the gun may damage the insert or create enough pressure within the cylinder of the gun to rupture the cylinder walls.

The assignee of the present invention has adapted a hydraulic gun of the type mentioned above so that the hydraulic mechanism can be made inoperative after the mandrel has moved a certain distance irrespective of the repeated pumping of the gun. While this is a highly advantageous feature, it has been found that different inserts require different depths and therefore varying predetermined distances of mandrel movement.

It is therefore a paramount object of the present invention to provide for an improved hydraulic gun which can be operated in a consistent manner and which minimizes insert or cylinder damage and can be used with various sizes of inserts.

It is another important object of the present invention to provide for an improved hydraulic gun that can be adjusted for different sizes of inserts.

SUMMARY OF THE INVENTION

An improved hydraulic gun for the installation of inserts comprises a mandrel capable of being threaded into an insert, a hydraulic assembly which withdraws the mandrel from an opening in a panel into which the threaded insert has been placed, and a means associated with the hydraulic assembly for adjusting the distance the mandrel moves upon withdrawal. The adjustment of this distance allows the gun to be used with a variety of different insert sizes.

DESCRIPTION OF THE PREFERRED EMBODIMENTS

Figure 1:
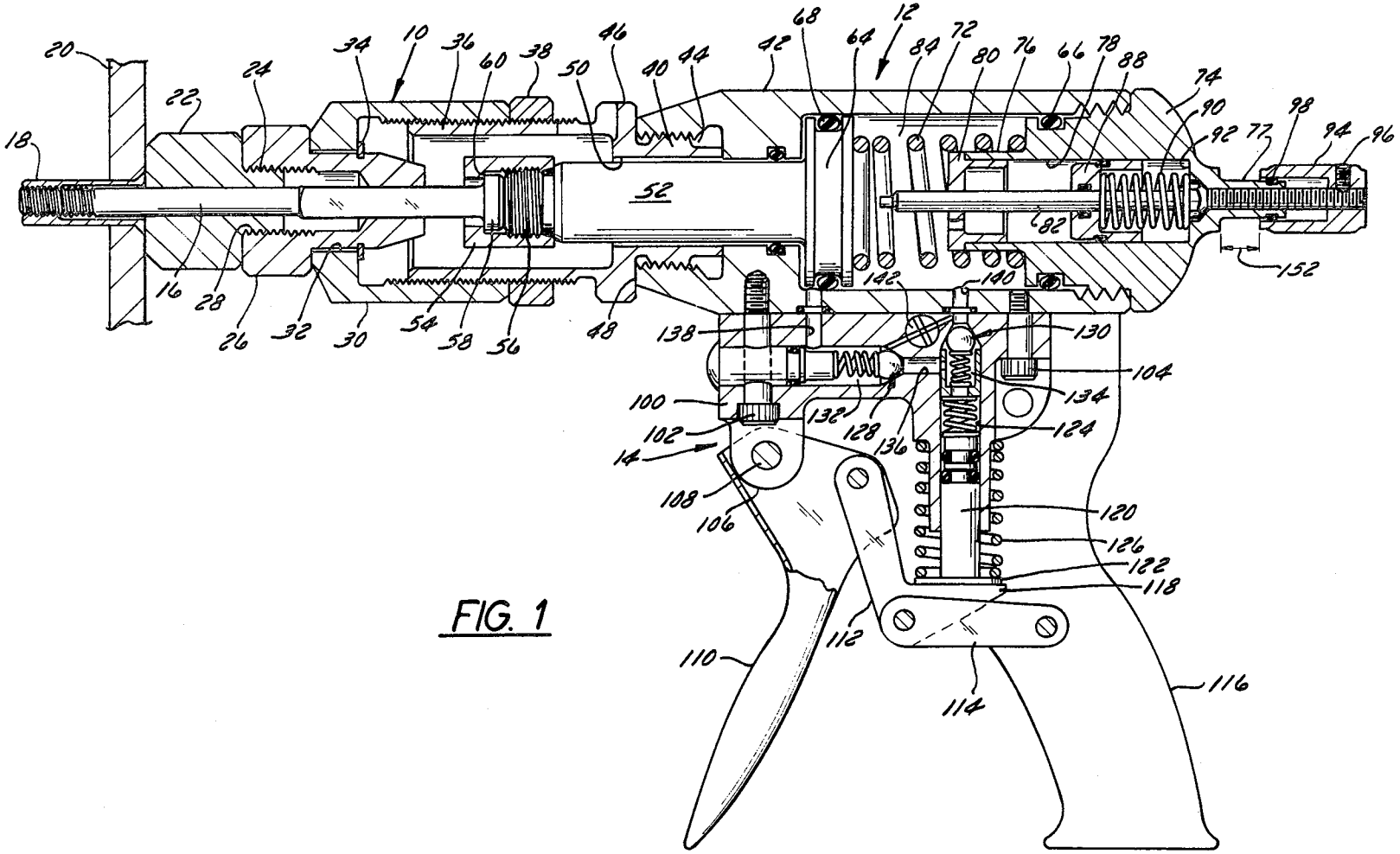
FIG. 1 is a side-sectional view of the hydraulic gun of the present invention.

As illustrated in FIG. 1, the hydraulic gun of the present invention is comprised of three major sections: an anvil assembly 10; a hydraulic housing assembly 12; and a pump assembly 14. Functionally, the anvil assembly 10 provides, in part, the operator with a means to properly adjust the gun in order to install the insert correctly during operation. The hydraulic housing assembly 12 along with mandrel 16 functions to lock the insert 18 into panel 20. The pump assembly serves as a handle for the operator and additionally functions to provide the activating hydraulic pressure to the housing 12 for movement of piston 52.

As a part of anvil assembly 10, anvil 22 serves as a flush and stabilizing abutment against the circular flange of an insert which is flush against the surface of panel 20. Anvil 22 is made out of a hard material and is capable of being threaded by means of a threaded cylindrical extension 24. Extension 24 itself is threaded into bore 28 of anvil retainer 26 so that the interior facing walls of each are in an abutting relationship. Anvil 22 contains a bore which is oriented coaxially with bore 28 to receive mandrel 16. The right-hand portion of anvil retainer 26 has diameter sufficiently reduced to be received within opening 32 of adjustable sleeve 30. Ring 34 secured to anvil retainer 26 prevents removal thereof from sleeve 30.

A cylindrical coupling 36 having threaded surfaces on left and right extensions engages, respectively, adjustable sleeve 30 and inner surface of bore 44 of cylinder 42. Thus, coupling 36 serves as a mount for adjustable sleeve 30 and secures the anvil assembly 10 to cylinder and piston assembly 12. When fully threaded into bore 44, extension 40 of coupling 36 and ring 46 abut, respectively, against the rear wall of bore 44 and the end wall 48 of cylinder 42. Additionally, extension 40 has opening 50 sufficiently large to receive piston 52.

While mandrel 16 is positioned within anvil 22 and anvil retainer 26, it is necessary to secure mandrel 16 to the end of piston 52. This is accomplished by collar 54 which is threadedly mounted on the reduced diameter portion 56 of piston 52. The head 58 of mandrel 16 loosely abuts piston 52 and is secured against axial movement by inner flange 60 of collar 54.

Piston 52 is slidably received by cylinder 42. In the fully extended position, piston head 64 is close to or abuts the interior wall of cylinder 42. O-ring seal 68 is located between the parallel flanges of head 64 respectively to seal the opening in cylinder 42 and the space between piston head 64 and the interior wall of of cylinder 42.

A spring 72 engages piston head 64 and is coiled around cylindrical extension 76 of end cap 74 which is threaded into the other end of cylinder 42. Spring 72 biases head 64 to the left, thus maintaining mandrel 16 in an extended position. An O-ring seal 66 is located between cap 74 and the inner wall of cylinder 42. Cap 74 has a bore 78 into which a plug 80 is pressed at one end. Plug 80 contains a central opening adapted to receive pin 82 which extends a substantial length of cylinder 42 and is threaded into an opening within extension 77 of cap 74. Piston 88 slides on pin 82 within bore 78 and serves as an abutment to spring 90. The other end of spring 90 rides against the rear wall 92 of bore 78. Mounted on the threaded portion of pin 82 extending beyond end cap 74 is an adjustment cap 94 which is secured to pin 82 by set screw 96. The adjustment cap 94 may be in the form of a sleeve which slideably receives extension 77. A friction O-ring 98 restricts movement of cap 94 over extension 77.

Pump handle assembly 14 through valve housing 100 is mounted beneath and secured to cylinder 42 by bolts 102, 104. A flange 106 extending downwardly from housing 100 provides a mount for pin 108 and pump handle 110. Links 112, 114 couple handle 110 to grip 116. Link 112 has an arm 118 with a horizontal surface which abuts and provides a support to head 122 of piston 120 positioned within cylinder 124 of valve housing 100. Piston 120 is biased against arm 118 by spring 126 mounted around the outside of cylinder 124. The upper end of spring 126 rides against housing 100.

Withing housing 100 are two spring biased valves 128, 130 positioned respectively at the end of chambers 132, 134. A port 136 provides fluid communication between chambers 132 and 134. Chamber 132 communicates through port 138 with cylinder 42 between piston head 64 and the left wall of cylinder 42 while chamber 134 communicates through port 140 with cylinder 42 on the right side thereof. A pressure relief valve 142, normally closed, provides direct communication between the right side of cylinder 42 and chamber 132.

Figures 2, 3:
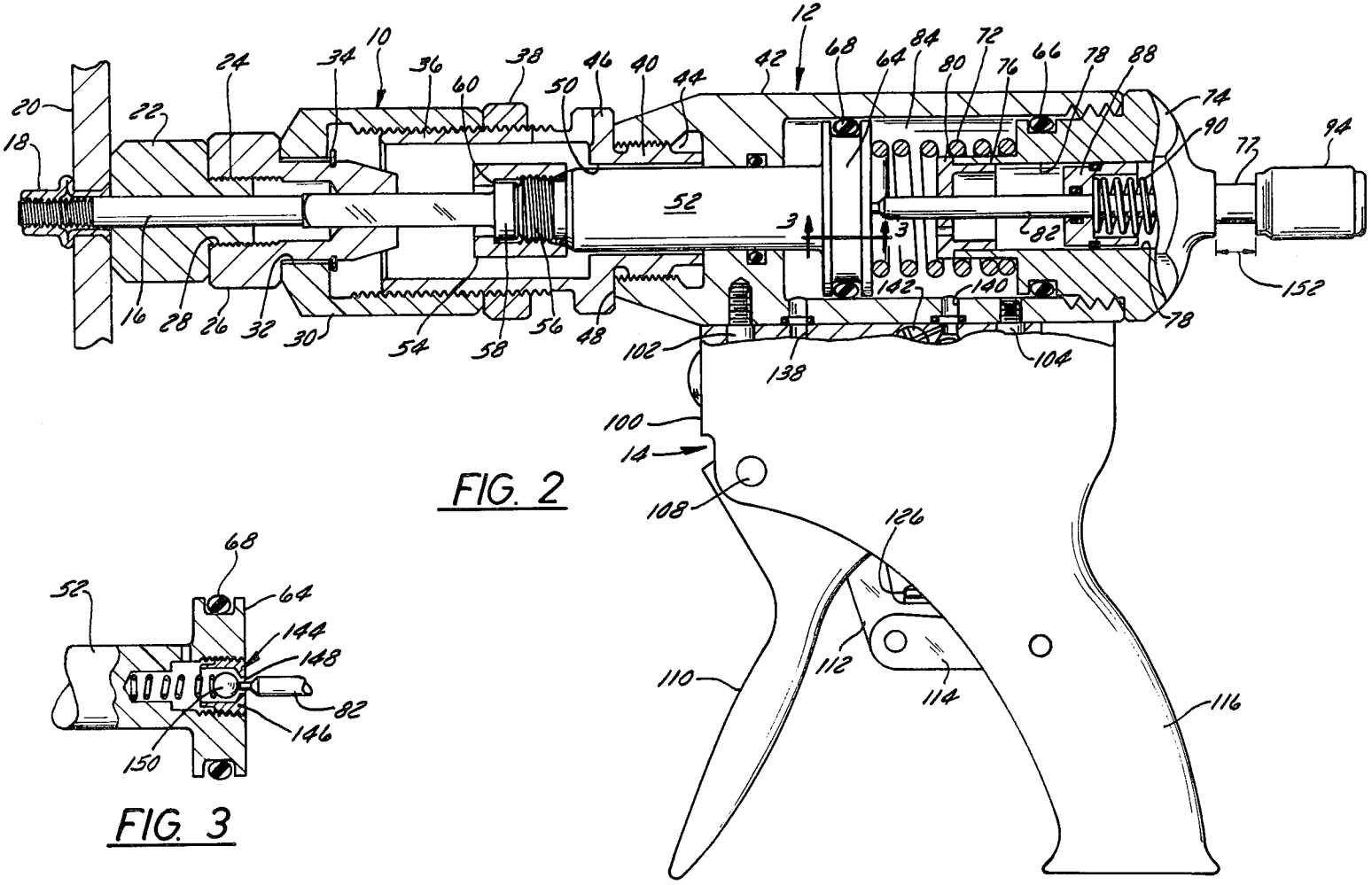
FIG. 2 is a side-sectional view (with some details omitted) of the hydraulic gun showing the position of parts after installation of an insert.
FIG. 3 is a sectional view taken along lines 1—1 of FIG. 2.

As illustrated in FIG. 3, a spring biased ball valve 144 is positioned within piston head 64. A valve seat 146 which threads into piston head 64 has a small centrally located opening 148 adapted to receive the end of pin 82, allowing pin 82 to engage ball 150, thereby allowing the volumes on either side of head 64 to be in direct communication.

To operate the handgun, an operator threads an insert 18 on the threaded end of mandrel 16 and places the insert 18 into the opening in panel 20 as seen in FIG. 1 until the flanges of the insert flush against panel 20. The handgun is held horizontally and handle 110 is pumped, causing arm 118 to rise thus forcing piston 120 into cylinder 124. Fluid within cylinder 124 is forced through valve 128 and into chamber 132. The return of piston 120 to its original position, allows fluid within chamber 84 on the other side of piston head 64 to flow through valve 130 into chamber 134. The differential in hydraulic pressure on piston head 64 causes it to move to the right as seen in FIG. 2, thus withdrawing mandrel 16. Because the anvil 22 maintains the flanges of the insert against the panel, the walls of insert 18 fold thereby locking insert 18 in panel 20 as illustrated in FIG. 2 also. Mandrel 16 can then be unthreaded from insert 18 by rotating anvil retainer 26 counterclockwise.

As stated before, problems can occur if the operator continued pumping the handgun so that mandrel 16 moves a distance greater than necessary for proper locking of the insert. Pumping too much results in damage to the insert and possibly to the gun itself, manifested in a rupture of the cylinder. To eliminate this problem, strike pin 82 engages ball 150 after the mandrel and piston 52 have moved a predetermined distance, i.e. the distance necessary for proper locking of an insert. Thus the pressure on both sides of piston head 64 is equalized and motion of mandrel 16 ceases.

Adjustment of the distance necessary for proper locking of an insert can be altered simply by the rotation of adjustment cap 94. This causes strike pin 82 to rotate and move toward or from piston head 64 as desired. The gap denoted by numeral 152 between adjustment cap 94 and end cap 74 corresponds to the predetermined distance. Because of the various sizes of inserts, the predetermined distance will necessarily vary with inserts. Markings along extension 77 may be employed to indicate the appropriate predetermined distance.

At times, the depth in which a mandrel 16 penetrates an opening may vary. This is easily accomplished by loosening lock ring 38 and rotating adjustable sleeve 30. Rotation of sleeve 30 alters the length of mandrel 16 which extends out from anvil 22. Alternatively, anvil 22 could be replaced with anvils of different dimensions.

Still another change may be necessary if an insert of a different diameter is to be inserted and locked. This necessitates the use of a mandrel of a different diameter also. By removing the anvil assembly 10 and the cylindrical coupling 36. Together as a unit, collar 54 can be loosened and removed. The mandrel can then be removed and a new one inserted.

It should now be readily apparent from the foregoing that various modifications and changes may be made to the hydraulic gun of the present invention without departing from the intended scope of the appended claims.

I claim:

1. A hydraulic insert fastener gun comprising (a) A mandrel adapted to receive an insert for installation in a panel;

(b) hydraulic means for moving said mandrel from a first position to a second position, said hydraulic means including an adjustable stroke limiting means for rendering said hydraulic means inoperable after said mandrel has moved a predetermined distance from the first position;

(c) means for actuating said hydraulic means;

(d) said hydraulic means further includes a cylinder and a piston with a spring-biased ball valve means positioned with in the head of said piston and providing fluid communication between the volumes of the cylinder separated by said piston head, said valve means normally being closed; and (e) said adjustable stroke limiting means including a stationary shaft mounted substantially axially in said cylinder and having an end which contacts and opens said ball valve after said piston has moved a predetermined distance.

2. The hydraulic gun of claim 1 in which said stroke limiting means includes means for varying the predetermined distance.

3. The hydraulic gun of claim 2 in which said means for varying the distance includes an adjuster cap fixedly secured to said shaft for moving said shaft in the axial direction.

4. The hydraulic gun of claim 3 in which said shaft is threadedly mounted in a rear wall extension of said gun and said adjuster knob is secured to a portion of said shaft extending through said rear wall extension.

5. The hydraulic gun of claim 3 in which said rear wall extension is slidably received by said adjustor cap.

6. The hydraulic gun of claim 5 in which the outer surface of said rear wall extension bears indicia indicating a selected predetermined distance when aligned with said adjuster cap.

7. A hydraulic gun for the installation of fastener inserts into a panel comprising (a) a cylinder and piston with a biased closed valve means located in the piston head;

(b) a mandrel fixedly mounted adjacent to and abutting the other end of said piston;

(c) a shaft externally adjustably mounted for axial movement and having one end within the cylinder which is adapted to contact and open said valve means after said piston has traveled a predetermined distance; and (d) shaft adjusting means mounted on the other end of said shaft for adjusting the position of said shaft along its axis, thereby changing the predetermined distance.

8. The hydraulic gun of claim 7 in which said cylinder has a rear wall with a threaded bore adapted to receive a complimentary threaded length of said shaft, said shaft extending through said threaded bore and supporting an adjustor knob fixed against relative movement with respect to said shaft whereby rotation of said adjustor knob causes said shaft to move axially with respect to said valve means.

9. The hydraulic gun of claim 8 in which the distance between said adjustor knob and the rear wall of said cylinder is equal to the predetermined distance.

10. The hydraulic gun of claim 8 in which an extension of said rear wall defines said threaded bore, said adjustor knob being a sleeve which slideably receives said extension, said extension bearing indicia for indicating the predetermined distance which aligned with said knob.

* * * * *

UNITED STATES PATENT AND TRADEMARK OFFICE

CERTIFICATE OF CORRECTION

PATENT NO. : 4,462,240

DATED : July 31, 1984

INVENTOR(S) : Albert K. Yamamoto

It is certified that error appears in the above-identified patent and that said Letters Patent is hereby corrected as shown below:

The title page should be deleted to appear as per attached title page.

Signed and Sealed this

*Twenty-second* Day of *January 1985*

[SEAL]

*Attest:*

DONALD J. QUIGG

*Attesting Officer* *Acting Commissioner of Patents and Trademarks*

United States Patent [19]

Yamamoto

[11] Patent Number: 4,462,240

[45] Date of Patent: Jul. 31, 1984

[54] HANDGUN, BLIND RIVET INSTALLATION

[75] Inventor: Albert K. Yamamoto, Huntington Beach, Calif.

[73] Assignee: Rexnord Inc., Brookfield, Wis.

[21] Appl. No.: 392,196

[22] Filed: Jun. 25, 1982

[51] Int. Cl.[3] ..... B21D 9/05

[52] U.S. Cl. ..... 72/391; 92/13.6

[58] Field of Search ..... 72/391, 114; 92/13.6

[56] References Cited

U.S. PATENT DOCUMENTS

| | | | |
|---|---|---|---|
| 3,104,592 | 9/1963 | Sheesley | 92/13.6 |
| 4,086,802 | 5/1978 | Ewig, Jr. | 72/391 |
| 4,321,814 | 3/1982 | Martin | 72/391 |

*Primary Examiner*—Francis S. Husar
*Assistant Examiner*—Linda McLaughlin

[57] ABSTRACT

A hydraulic gun for installing inserts in which the hydraulic mechanism becomes inoperative after the mandrel of the gun travels a predetermined distance. The gun includes a means for adjusting the predetermined distance of mandrel movement.

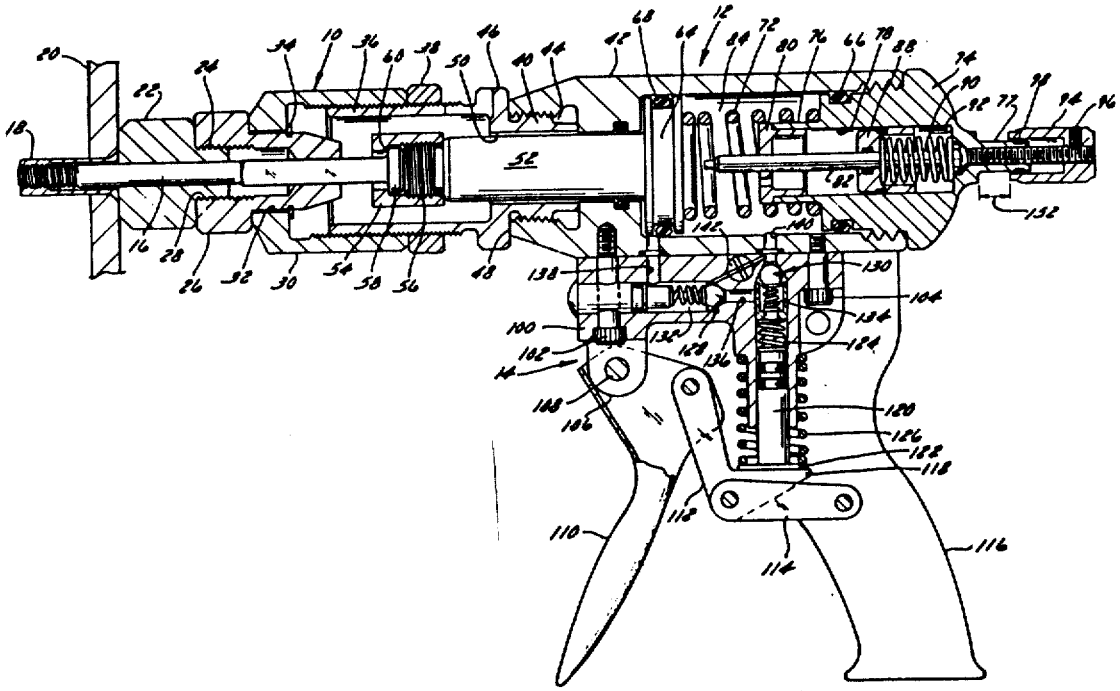

10 Claims, 3 Drawing Figures